United States Patent [19]

Plastino

[11] 4,345,336

[45] Aug. 24, 1982

[54] HEAD PROTECTING HEADWEAR

[76] Inventor: Mario A. Plastino, 659 Mastic Rd., Mastic, Long Island, N.Y. 11950

[21] Appl. No.: 115,392

[22] Filed: Jan. 25, 1980

Related U.S. Application Data

[63] Continuation-in-part of Ser. No. 25,479, Mar. 30, 1979, abandoned.

[51] Int. Cl.[3] ..... A42B 1/18; A42B 3/00

[52] U.S. Cl. ..... 2/187; 2/414; 2/DIG. 6

[58] Field of Search ..... 2/414, 421, 181, 183, 2/187, 190, 195, 197, 199, DIG. 6

[56] References Cited

U.S. PATENT DOCUMENTS

| | | | |
|---|---|---|---|
| 238,865 | 3/1881 | Davis | 2/183 UX |
| 1,575,251 | 3/1926 | Cairns | 2/190 X |
| 2,000,540 | 5/1935 | Uhlmann et al. | 2/183 X |
| 2,181,106 | 11/1939 | Timmons et al. | 2/187 |
| 3,263,235 | 8/1966 | Young | 2/187 X |

FOREIGN PATENT DOCUMENTS

| | | | |
|---|---|---|---|
| 801321 | 9/1958 | United Kingdom | 2/414 |

*Primary Examiner*—Peter P. Nerbun

*Attorney, Agent, or Firm*—Gottlieb, Rackman & Reisman

[57] ABSTRACT

Head protecting headwear in the form of a helmet is disclosed. The helmet includes a resilient, plastic shell which defines a head receiving opening and which has a protective peak. A sweatband is fastened to the shell, adjacent the head receiving opening. The helmet also includes a cover, formed of a stretchable fabric, which slips over the shell and snugly fits thereon. The cover may be removed for purposes of washing or replacement. Fastening elements, disposed on the peak and the cover, may also be provided for securing the cover to the shell and also for preventing the cover from "drooping" relative to the peak.

20 Claims, 8 Drawing Figures

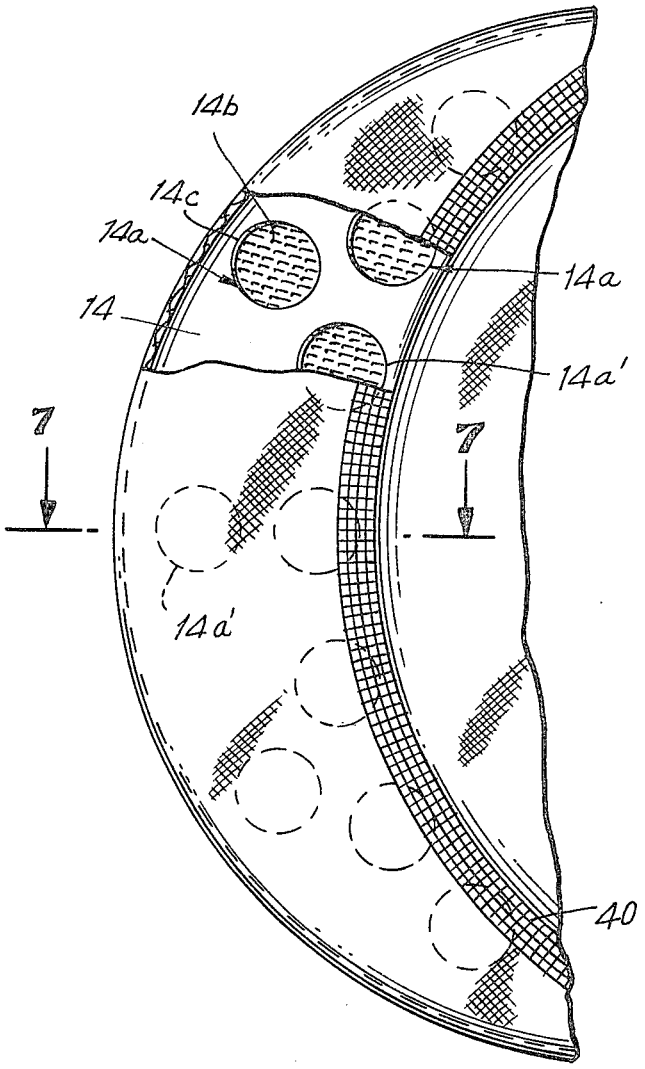
FIG. 6
FIG. 7
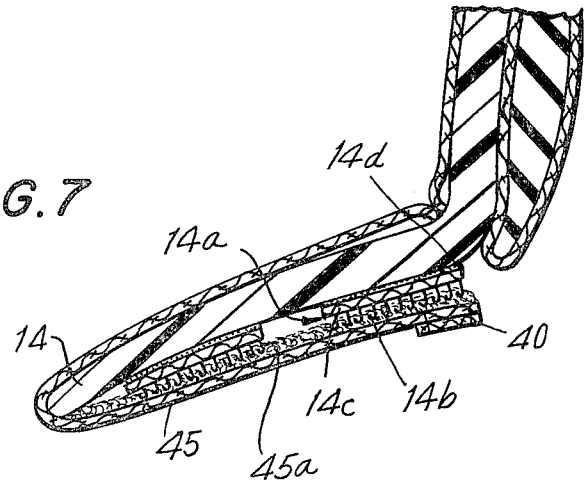

HEAD PROTECTING HEADWEAR

This application is a continuation-in-part of my application Ser. No. 025,479, filed on Mar. 30, 1979 now abandoned.

This invention relates generally to head protecting headware and, more particularly, to a head protecting helmet of the type used for riding or other equestrian events.

Riding or equestrian helmets or similar protective headwear are generally well-known in the art. These helmets often include a resilient shell which contains a shock absorbing interior to absorb and snub blows received on the crown area of the helmet thereby protecting the head of a wearer. Such helmets are disclosed in two of my previous patents, U.S. Pat. Nos. 3,706,101 and 3,790,962.

Although the helmets disclosed in the aforementioned patents are quite satisfactory, from the standpoint of protecting the wearer from blows to the head, there exists the need in the art to provide head protecting headwear, in the form of a riding helmet, which can be manufactured relatively inexpensively, while still providing the necessary degree of protection for the wearer.

Another need of the prior art is to provide head protecting headwear, in the form of a riding helmet, which has a removable cover which snugly fits over the resilient shell. For example, the prior art helmets shown in my two aforementioned patents, are both covered by a decorative fabric which is permanently bonded to the shell by glue or the like. Although this provides a riding helmet which is attractive in appearance, it nonetheless increases manufacturing costs, both in material and in time required to permanently bond or otherwise attach the decorative fabric to the shell.

Head protecting headwear, in the form of a riding helmet, which has a removable fabric cover, has the further advantage of allowing the cover to be removed from the shell in those instances where the cover becomes soiled or faded. In these situations, the cover can be washed and then replaced over the shell or a new cover can be provided over the shell if the original cover has been torn or otherwise damaged. The original cover can also be replaced with a different colored cover, should the wearer decide to have a helmet of a different color. Thus, a riding helmet having a removable cover is not only more efficient to manufacture, but is often more versatile in use as compared to riding helmets having decorative fabric permanently bonded or attached to the protective shell.

In two more of my patents, U.S. Pat. Nos. 3,103,015 and 3,203,003, I disclosed head protecting headwear capable of protecting the wearer against head injury, without detracting from or calling attention to the wearer's appearance. To this end, I disclosed in these patents, headwear having a removable protective inner shield, which was formed of plastic, and which had a resilient lining. In U.S. Pat. No. 3,103,015, the shell was formed with a marginal portion which fitted within the sweatband of a conventional hat, thereby keeping the shell in place. In U.S. Pat. No. 3,203,003, the shell and the hat fitting over it were kept together, by the use of studs and screws or snap fasteners. This is generally inappropriate for equestrian helmets which require a sleek appearance.

The protective headwear shown in my U.S. Pat. Nos. 3,103,015 and 3,203,003 were not directed to a riding helmet having a fabric cover which snugly fits over the resilient shell. In both cases, the patents were directed to headwear which could provide a "street" appearance.

Accordingly, it is a broad object of the present invention to provide head protecting headwear, in the form of a riding helmet, which is relatively economical to manufacture.

Yet another object of the present invention is to provide head protecting headwear, in the form of a riding helmet, which has a removable cover thereby allowing the cover to be replaced when the cover is either soiled or damaged.

A still further object of the present invention is to provide head protecting headwear, in the form of a riding helmet, which has a removable cover which securely fits over the helmet's resilient shell.

A still further object of the present invention is to provide head protecting headwear, in the form of a riding helmet having a sleek appearance, which has a removable cover which fits over the resilient shell of the helmet and which may be changed for purposes of changing the color of the helmet.

These and other objects of the present invention are obtained by providing head protecting headwear, in the form of a riding helmet, having a resilient shell defining a head receiving opening, said shell having a peak sloping downwardly from a portion of said head receiving opening. A sweatband is attached to the shell, adjacent the head receiving opening. The helmet includes a cover which snugly fits over the shell and which may be removed for cleaning or the like. The cover, which includes a peak receiving portion for receiving the peak of the shell, is trimmed in elastic in order to maintain the cover snugly over the shell. The helmet also includes an elastic strap for maintaining the helmet on the head of a wearer, with the elastic strap placed at the peak when the strap is not being used. The elastic strap may be secured either to the inside or outside of the shell, adjacent the head receiving opening. According to one embodiment of the invention, the peak receiving portion of the cover includes fastening means which cooperates with complementary fasting means on the shell peak for snugly maintaining the cover relative to the peak.

The above brief description of the present invention will become more apparent with reference to the following detailed description of presently preferred, but nonetheless illustrative, embodiments of the present invention, when taken in conjunction with the following drawings, wherein:

FIG. 6 is a partial bottom view, partly broken away, of a fourth embodiment of the present invention; and FIG. 7 is a partial sectional view, taken along the line 7—7 of FIG. 6 and enlarged in scale.

Figure 2:
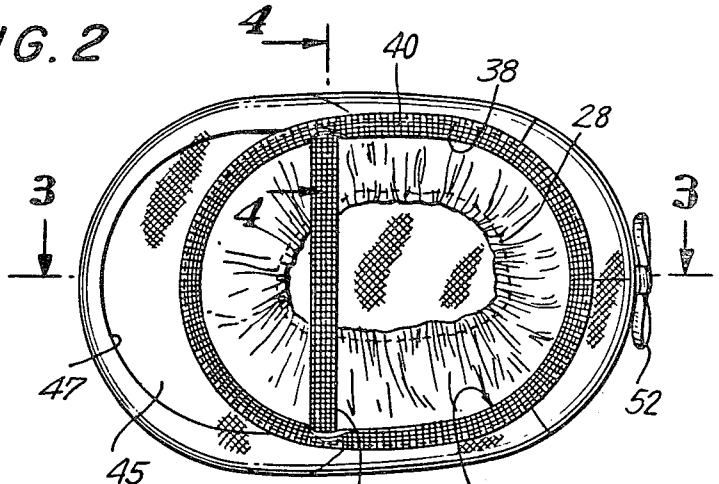
FIG. 2 is a bottom view of the helmet of FIG. 1.

Referring now to the drawings and, more particularly, to FIGS. 1–4 thereof, a protective helmet according to the present invention is generally designated 10. Although helmet 10 can be any type of head protecting headwear, helmet 10 is advantageously a riding or equestrian helmet.

The helmet 10 has a resilient shell 12 having a generally spherical crown portion 11, the bottom of which defines a head receiving opening 13. The resilient shell 12 is preferably formed of a rigid, shock resistent material, such as rigid synthetic plastic or metal, and has a peak or visor, generally designated 14, which slopes downwardly and away from a portion of the head receiving opening 13 at the front of shell 12, i.e., so that the peak is above the wearer's eyes when the helmet is being worn.

A sweatband, generally designated 16, is secured to the shell 12 at the head receiving opening 13. The sweatband includes a first layer of material 18 which is glued or otherwise secured to the outside of the shell adjacent the head receiving opening (see FIG. 4). This layer of material is also secured to the underside of peak 14 by glue or other common means of attachment (see FIG. 3). A second layer of material 20 is stitched to the first layer of material 18, with the two layers 18, 20 separated by a piece of foam 22 or similar material. Thus, stitching 24 and stitching 26 connect sweatband layer 18 to sweatband layer 20, with this stitching going through the foam padding 22. Additional stitching 27 also serves to hold the foam in place, with stitching 27 going through foam 22 and the sweatband layer 18, the latter folded over the foam at its upper edge.

The sweatband layer 20 is sewn by stitching 28 in order to provide an adjustment feature for the sweatband. To this end, a tie 30 is provided in the loop formed by stitching 28, with a cut-out (not shown) in the sweatband layer 20 allowing the tie 30 to be tightened to adjust the size of the sweatband at that part of the sweatband which rests on the top of the head of the wearer.

The top of the shell 12 may be provided, on the interior thereof, at its apical portion, with a layer of padding material 32, such as foam, rubber or the like, which is covered by a layer of fabric 34. The foam material 32 provides reserve protection for the top of the wearer's head.

Helmet 10 includes a cover 36 which is provided to fit over the resilient shell 12. The cover is preferably formed of a stretchable fabric material, such as a "velor" or the like, and snugly but removably fits over shell 12. Fabric cover 36 is generally shaped to conform to the contour of shell 12 and includes an opening 38 (see FIG. 2) through which the wearer's head is inserted when the fabric cover is placed on the resilient shell. A band of elastic 40 trims the cover 36, with the elastic secured around opening 38 by stitching or the like. The fabric cover 36 has a crown portion, formed of a plurality of generally triangular panels 42, sewn together at seams 43, and a peak portion, formed by panels 44 and 45, which are sewn together at seam 47. The peak portion of the fabric cover is connected to the crown portion of the fabric cover at seam 49.

Figure 4:
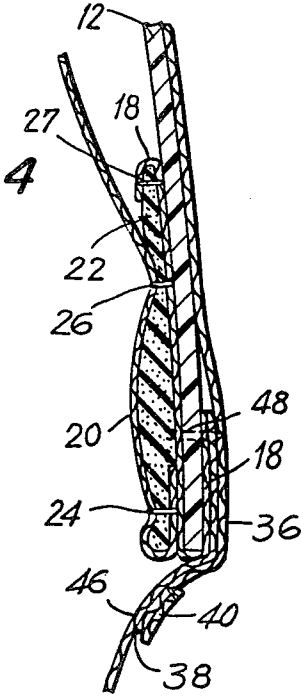
FIG. 4 is a partial sectional view, taken along the line 4—4 of FIG. 2.
Figure 1:
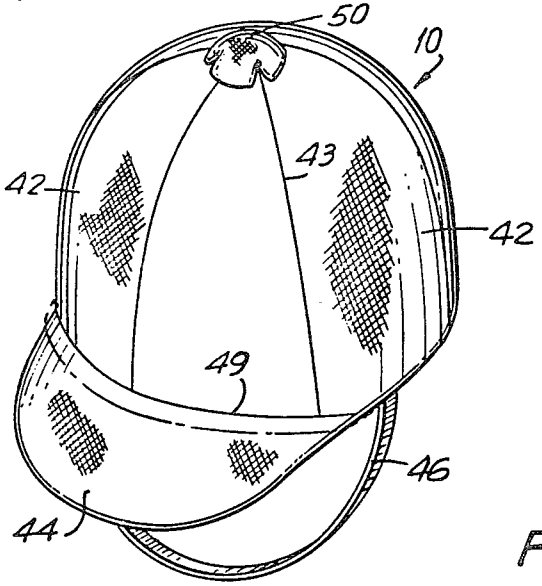
FIG. 1 is a front perspective view of a protective helmet according to one embodiment of the present invention.

An elastic strap 46 is stapled or otherwise secured to the outside of the shell 12 by staples 48 or similar means which pass through elastic 46, sweatband layer 18, shell 12 and the other side of sweatband layer 18, as shown in FIG. 4. The elastic strap 46, as shown in FIG. 1, may be pulled beneath the chin of a wearer when the helmet is being worn or, when not in use, may rest on the peak of the cap, along stitching 49. This latter position of the elastic strap 46 is shown in the dot and dashed line in FIG. 1.

The fabric cover 36 also includes a decorative button 50 located at the top of the cover, and a decorative bow 52, located at the cover, near the back of the helmet. Button 50 is attached to fabric cover 36 by appropriate fastening means, for example, by a pronged pin 54 which fastens the button to the fabric cover and the decorative bow is also stitched or otherwise secured to the cover. This provides for more efficient manufacture than helmets of conventional design, where the decorative buttons and/or decorative bows are usually attached directly to the resilient shell 12.

Alternative embodiments of the present invention are illustrated in FIGS. 4A, 5, 6 and 7.

Figure 5:
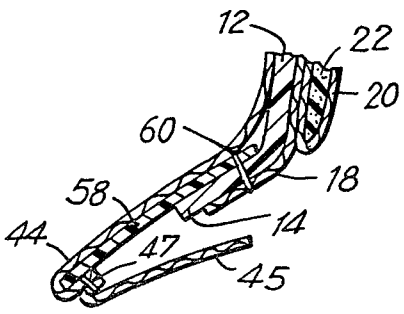
FIG. 5 is a partial sectional view, showing a third embodiment of the present invention.

In one embodiment, shown in FIG. 5, the resilient shell 12 has a relatively short rigid peak 14, to which is attached a resilient, yet bendable, peak extension 58. The peak extension 58 is attached to the peak 14 by appropriate fastening means, for example, by glueing the extension to the bottom of the peak or by using staples 60. The extension 58, which is formed on a stiffly flexible material, such as relatively thick polyethylene sheet material, is adapted to bend or fold when the front of helmet 10 is subjected to a blow. Thus, in the embodiment of FIG. 5, the "energy absorbing" peak reduces injury to the wearer in those circumstances where the front of the helmet is subjected to force. It is noted in this embodiment that the peak 14 and the peak extension 58 are of a size, and the fabric cover 36 is formed in a manner, sufficient for the cover to fit over the resilient shell 12, as shown in FIG. 5.

Figure 4A:
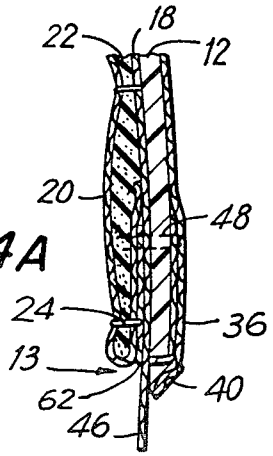
FIG. 4A is a partial sectional view, similar to the view of FIG. 4, but showing a second embodiment of the present invention.
Figure 3:
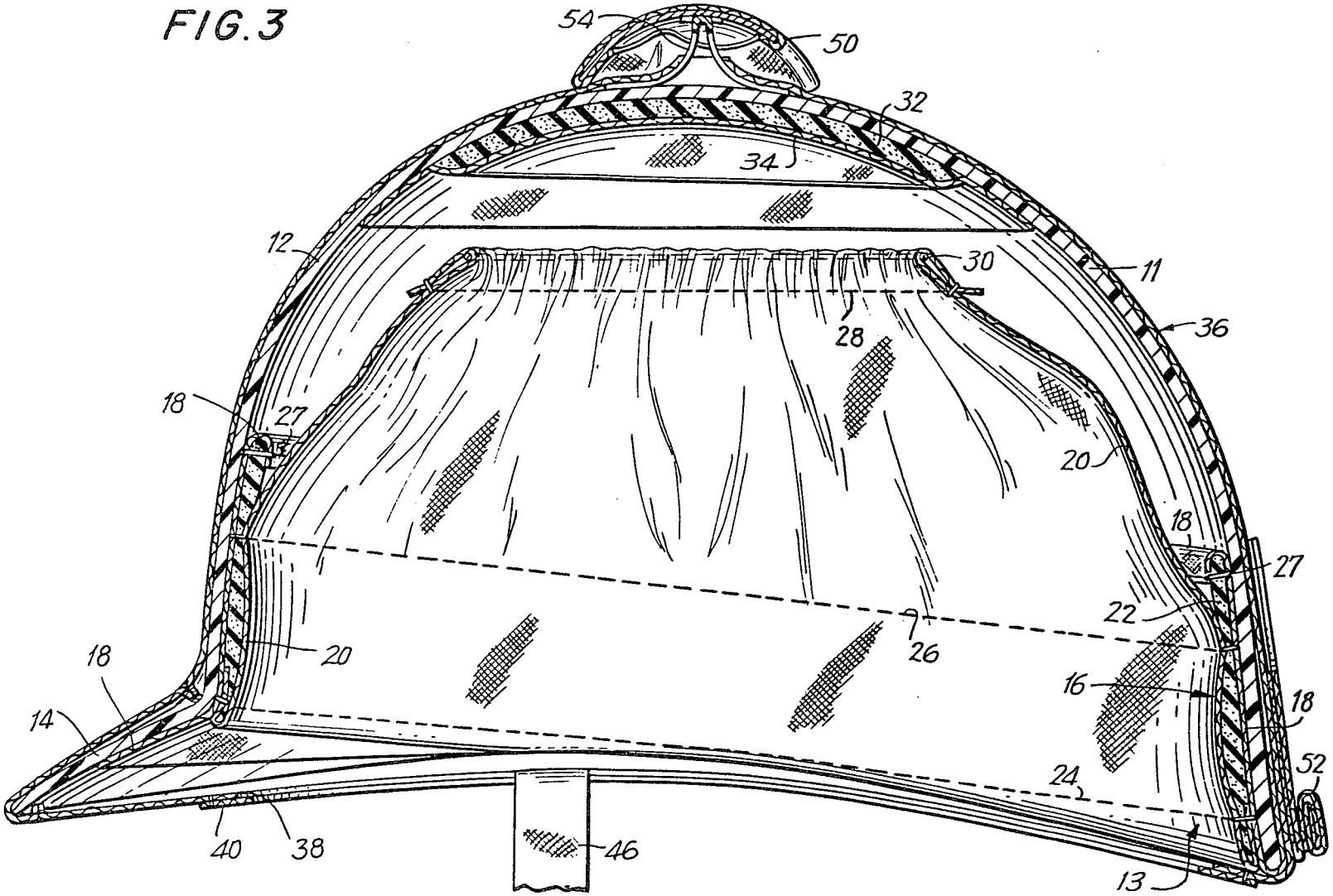
FIG. 3 is a sectional view, taken along the line 3—3 of FIG. 2 and enlarged in scale.

In another embodiment of the invention, illustrated in FIG. 4A, the elastic strap 46 is fastened, by staples 48, to the inside of the resilient shell 12, at the head receiving opening 13. A slit 62 in the sweatband layer 18 allows the elastic strap 46 to pass through this sweatband layer. It has been found advantageous to connect the elastic strap 46 to the inside of the resilient shell 12; this provides a cleaner look for the helmet, since the strap does not "pull" on the fabric cover 36 at opening 38 when the strap is pulled down over the chin of a wearer.

In another embodiment of the invention, illustrated in FIGS. 6 and 7, means are provided for removably fastening the cover to the underside of the peak 14. In particular, the underside of peak 14 is provided with means, generally designated 14*a*, which cooperates with means, generally designated 45*a*, carried by panel 45 of the cover. In the specific embodiment shown, means 14*a* and the complementary corresponding means 45*a* are typically sold under the name "Velcro." The means 14*a* is fabricated of a synthetic adhesive and consists of a plurality of "hooks" 14*b* which are secured to a backing 14*c*. The means 14*a* advantageously takes the shape of a series of button-like members 14*a*', each of which is connected to the underside of peak 14 by an appropriate adhesive 14*d*. In the embodiment illustrated in FIG. 6, ten button-like members 14*a*' are shown. However, the particular number of button-like members and the shape thereof is a matter of choice. The means 45*a* carried by panel 45 is also fabricated of a synthetic adhesive and consists of "Velcro" matting. When means 14*a* and complementary means 45*a* are pressed together, hooks 14*b* engage matting 45*a* to secure the cover panel 45 to the underside of peak 14. The matting 45*a* may be separately attached to panel 45 or, in the alternative, the matting 45*a* and the panel 45 may be a single unit, with the panel formed of "Velcro" matting and backing therefor.

It will be appreciated, with particular reference to FIG. 7, that means 14*a* on the underside of peak 14 and means 45*a* on the inside of cover panel 45 cooperate with each other so that panel 45 is maintained in close contact with the underside of the peak. This not only secures the cover to the shell, but also provides a sleek and stylish appearance, since the cover is prevented from "drooping" below the peak. (As indicated in a comparison of the location of panel 45 in FIG. 5 and FIG. 7, panel 45 in FIG. 7 is much closer to the underside of peak 14 than panel 45 is related to the underside of peak 14 in FIG. 5.)

It will be appreciated, therefore, that the present invention provides a head protecting headwear, particularly useful as a riding or equestrian helmet which overcomes the difficulties of prior art helmets and which achieves the objects stated heretofore.

In particular, the present invention provides a riding or equestrian helmet having a removable cover 36 formed of a stretchable fabric which fits snugly and smartly over a protective resilient shell 12. The cover is held in place over the shell, and is not prone to slippage, by the co-acting of the elastic trim 40 located at the opening 38 of the cover, the shape of the cover itself, and fastening means 14*a*, 45*a* cooperating between the peak and the peak receiving portion.

More particularly, the elastic trim 40 exerts a force on the cover at the head receiving opening 13 of the resilient shell which tends to keep the cover in place. The cover 36 is also kept in place by the peak 14 and/or peak extension 58 of the shell, which fit into the peak "pocket" of the cover formed by panels 44 and 45. It should be noted that the cover should conform in shape to the shape of the shell, since this also serves to keep the cover in place over the shell and also provides a sleeker appearance. By fabricating the cover of fabric having a degree of stretch, the cover may be nonetheless removed from the shell while still snugly fitting over the outside of the shell and conforming to the outer shape of the shell. The snug fit and the sleek appearance are further assured by fastening means on the underside of the peak and at the peak receiving portion of the cover, at panel 45. This also serves to keep the cover secured to the helmet shell.

Fabric cover 36 may be either temporarily or permanently removed from the resilient shell 12. It may be temporarily removed for washing or cleaning purposes or where the wearer desires to have a different colored helmet. It may be permanently removed and replaced in those instances where the cover becomes worn or damaged. The replaceability feature of fabric cover 36 is a decided advantage from the standpoint of the wearer, since it allows the wearer versatility in both replacement of the individual cover (rather than the entire helmet) or in washing the cover or changing the cover color. These advantages have not been obtainable in previous riding helmets of this type.

Cover 36 may be formed of a stretchable material, such as velour. In an alternative embodiment, cover 36 may be formed of a more conventional material, such as velvet, wherein the elasticity or stretchability otherwise provided by velour-type material can be provided by cutting the velvet-type fabric on the bias, i.e., cutting in a diagonal direction across the grain of the fabric.

The fabric cover also provides decided advantages during the manufacturing process for the helmet. Thus, it is more efficient from a cost standpoint to merely slip the cover 36 over the resilient shell 12, than to have to glue a decorative fabric to the shell. Furthermore, it is easier in the manufacturing stage to provide a riding helmet where the sweatband is attached directly to the shell, rather than hand-sewn to the decorative fabric layer as is usually the case in riding helmets which do not have removable covers. Finally, it is more efficient to attach the decorative buttons and/or bows to the cover, rather than having to secure these directly to the resilient shell, as is the case where no removable cover is used.

Numerous modifications are possible in light of the above disclosure. By way of example, although "Velcro" fastening means has been disclosed, other ways of securing the panel 45 to the underside of peak 14 may be devised. Similarly, the fastening means may be secured not only to peak 14, but also to the underside of the peak extension 58 in those instances where an energy absorbing peak is used. It is to be understood, therefore, that the above described embodiments are merely illustrative and other embodiments may be devised by those skilled in the art, without departing from the spirit or scope of the present invention, as set forth in the appended claims.

What I claim is:

1. Headwear for protecting the head of a wearer comprising:

a resilient shell having a crown portion, a head receiving opening defined at the bottom of the crown portion, and a peak extending downwardly and outwardly from the head receiving opening at the front of said shell;

cushioning means disposed within said shell for cushioning the head of a wearer;

a removable cover generally shaped to conform to the contour of said shell, said cover including an opening for receiving said shell, a crown portion for fitting over the crown of said shell, a peak portion for receiving the peak of said shell, and elastic means for positioning and securing said cover in place over said shell; and means for removably connecting the peak of said shell to the peak portion of said cover, such that said connecting means and said elastic means coact to snugly secure said cover to said shell and prevent slippage thereof.

2. Head protecting headwear according to claim 1 further including strap means for maintaining said headwear on the head of a wearer.

3. Head protecting headwear according to claim 2 wherein said strap means is connected to the outside of the shell, adjacent said head receiving opening.

4. Head protecting headwear according to claim 2 wherein said strap means is connected to the inside of the shell, adjacent said head receiving opening.

5. Head protecting headwear according to claim 3 wherein said strap is at least partially covered by the cover at that part of the strap which is connected to the shell.

6. Headwear for protecting the head of a wearer according to claim 1, wherein said elastic means includes a band of elastic trim secured around said cover opening.

7. Headwear for protecting the head of a wearer according to claim 6, wherein the peak includes an underside surface for receiving the peak portion of said cover, and wherein said connecting means connects the underside of the peak to the peak portion of said cover.

8. Headwear for protecting the head of a wearer according to claim 7, wherein the peak portion of said cover includes a cover panel having an inside surface for placement over the underside of the peak.

9. Headwear for protecting the head of a wearer according to claim 8, wherein said connecting means connects said cover panel to the underside of the peak.

10. Headwear for protecting the head of a wearer according to claim 9, wherein said connecting means includes matting and hooks, said matting and hooks cooperatively disposed to be removably secured to each other.

11. Headwear for protecting the head of a wearer according to claim 10, wherein said matting is disposed on the inside of said cover panel and said hooks are disposed on the underside of the peak.

12. Headwear for protecting the head of a wearer according to claim 11, wherein said hooks on the underside of said peak and said matting on said cover panel cooperate to maintain said cover panel adjacent to the underside of said peak.

13. Headwear for protecting the head of a wearer according to claim 12, wherein said cushioning means includes a sweatband connected to said shell adjacent the head receiving opening.

14. Headwear for protecting the head of a wearer according to claim 13, wherein said sweatband includes a layer of cushioning material.

15. Headwear for protecting the head of a wearer according to claim 14, wherein said sweatband is adjustable.

16. Headwear for protecting the head of a wearer according to claim 15, wherein said cover is formed of a stretchable material, said material being cut on the bias to enhance the stretchability of said cover.

17. Headwear for protecting the head of a wearer according to claim 16, wherein said shell and the peak are fabricated of a rigid shock resistant synthetic plastic.

18. Headwear for protecting the head of a wearer comprising:

a resilient shell fabricated of a rigid shock resistant plastic having a crown portion, a head receiving opening defined at the bottom of the crown portion, and a peak having an underside surface extending downwardly and outwardly from the head receiving opening at the front of said shell;

an adjustable sweatband including a layer of cushioning material connected to said shell adjacent the head receiving opening;

a removable cover generally shaped to conform to the contour of said shell, said cover being fabricated of a stretchable material cut on the bias to enhance the stretchability of said cover, said cover including an opening for receiving said shell, a crown portion for receiving the crown of said shell, a peak portion having a cover panel for receiving the peak of said shell, said cover panel including an inside surface for placement over the underside of the peak, and an elastic band of trim secured around the cover opening for positioning said cover in place over said shell; and means for removably connecting said cover panel to the underside of the peak, said connecting means including matting disposed on the inside of said cover panel, and hooks disposed on the underside of the peak, such that said matting and hooks cooperate to maintain said cover panel adjacent to the underside of said peak, and said connecting means and said elastic means coact to snugly secure said cover to said shell and prevent slippage thereof.

19. Headwear for protecting the head of a wearer comprising:

a resilient shell fabricated of a rigid shock resistant plastic having a crown portion, a head receiving opening defined at the bottom of the crown portion, and a peak having an underside surface extending downwardly and outwardly from the head receiving opening at the front of said shell;

an adjustable sweatband including a layer of cushioning material connected to said shell adjacent the head receiving opening;

a removable cover generally shaped to conform to the contour of said shell, said cover being fabricated of a stretchable material cut on the bias to enhance the stretchability of said cover, said cover including an opening for receiving said shell, a crown portion for receiving the crown of said shell, a peak portion having a cover panel for receiving the peak of said shell, said cover panel including an inside surface for placement over the underside of the peak, and an elastic band of trim secured around the cover opening for positioning said cover in place over said shell;

an adherent synthetic matting secured to said cover panel; and an adherent synthetic backing member having front and rear sides, said rear side being adhesively secured to the underside of the peak, and said front side including a plurality of hooks for engaging said matting, such that when said matting and hooks are arranged in opposing relation and pressed into engagement, said matting and hooks cooperate to maintain said cover panel adjacent the underside of the peak, and said connecting means and said elastic means coact to snugly secure said cover to said shell and prevent slippage thereof.

20. Headwear for protecting the head of a wearer according to claim 19, wherein said matting and said cover panel form an integral unit, and wherein said backing member comprises a plurality of button-like members.

* * * * *